US007520413B1

(12) United States Patent
Cho et al.

(10) Patent No.: US 7,520,413 B1
(45) Date of Patent: Apr. 21, 2009

(54) JAM-RESISTANT TACKER APPARATUS

(75) Inventors: Bo-Seob Cho, Seoul (KR); Jong-Yeol Han, Seongnam-Si (KR)

(73) Assignee: Jeil Tacker Co., Ltd., Gwangju-Si, Gyeonggi-Do (KR)

( * ) Notice: Subject to any disclaimer, the term of this patent is extended or adjusted under 35 U.S.C. 154(b) by 0 days.

(21) Appl. No.: 12/003,432

(22) Filed: Dec. 26, 2007

(30) Foreign Application Priority Data

Oct. 24, 2007 (KR) ..... 10-2007-0107266

(51) Int. Cl.
*B25C 1/04* (2006.01)

(52) U.S. Cl. ..... 227/109; 227/119; 227/120

(58) Field of Classification Search ..... 227/109, 227/120, 119, 136, 8, 123, 130, 127
See application file for complete search history.

(56) References Cited

U.S. PATENT DOCUMENTS 3,720,364 A * 3/1973 Maestri ..... 227/109
3,797,723 A * 3/1974 Perkins et al. ..... 227/109
4,304,349 A * 12/1981 Novak et al. ..... 227/109
4,524,896 A * 6/1985 Morrell, Jr. ..... 227/126
4,749,115 A * 6/1988 Fehrs ..... 227/109
4,815,647 A * 3/1989 Chou ..... 227/109
5,522,533 A * 6/1996 Mukoyama et al. ..... 227/109
5,588,577 A * 12/1996 Chen ..... 227/120
5,632,431 A * 5/1997 Lin ..... 227/109
5,653,371 A * 8/1997 Hou ..... 227/109
5,704,532 A * 1/1998 Wey ..... 227/109
5,743,453 A * 4/1998 Chuang ..... 227/109
5,873,509 A * 2/1999 Liao ..... 227/109
5,934,539 A * 8/1999 Lee ..... 227/109
6,161,746 A * 12/2000 Wey ..... 227/109
6,345,754 B1 * 2/2002 Jeng ..... 227/109
6,398,097 B1 * 6/2002 Liang ..... 227/109
6,644,530 B2 * 11/2003 Chen ..... 227/109
6,715,657 B2 * 4/2004 Chen ..... 227/120
6,974,067 B2 * 12/2005 Chen ..... 227/120
7,004,368 B1 * 2/2006 Chen ..... 227/120
7,048,169 B2 * 5/2006 Sun ..... 227/120

* cited by examiner

*Primary Examiner*—Scott A. Smith
(74) *Attorney, Agent, or Firm*—GWiPS

(57) ABSTRACT

A jam-resistant tacker apparatus is invented, comprising a slit for engagement with an upper pin at the upper ends of a plurality of pin guides mounted to a magazine cover and forming a seating recess for receiving the upper pin at a predetermined position of the magazine so that the forward and backward movement range of the pin guides is increased, and by providing a spring having less elasticity than the spring of a pusher at the upper rear ends of the plurality of pin guides so that a tacker pin and the pusher can be guided while remaining in close contact. The present tacker apparatus is able to prevent of the problem of jammed tacker pins, by applying a horizontal elasticity for stably guiding the tacker pin horizontally in addition to an upward elasticity for moving the tacker pin upward.

5 Claims, 12 Drawing Sheets

JAM-RESISTANT TACKER APPARATUS

BACKGROUND OF THE INVENTION

1. Field of the Invention

The present invention relates to a jam-resistant tacker apparatus, and more particularly to a tacker apparatus that prevents tacker pins from becoming jammed by guiding a tacker pin and a pusher, which move within a connection area between a magazine and a magazine cover, to tightly contact the magazine without generating a gap.

2. Related Prior Art

As generally known, a tacker, a nailer, a stapler and a pinner are pneumatic machines widely used in the fields of interior and exterior construction, aluminum sash work and so on, to fasten certain materials to each other; for example, wood to wood, wood to plastic, wood to steel, or wood to concrete.

A general tacker apparatus comprises a body including therein a piston and a cylinder, a lid for supplying the piston with air and discharging the air therethrough, a magazine loaded with a nail, a staple, or a pin, a guide for guiding the trajectory of the nail, a safety device for safe operation, a fastening device for loading of the nail, a bracket firmly connecting the magazine to a handle, and a trigger assembly for operating the tacker apparatus.

In such a tacker apparatus, the piston disposed within the body is moved by operating the trigger assembly so that the nail or stapler loaded in the magazine is shot through the guide to penetrate a desired position.

FIGS. 1A and 1B are exploded perspective views illustrating the structures of the magazine and the pin guide members, respectively, constituting a conventional tacker apparatus. FIG. 2 is a plan sectional view showing the magazine of the conventional tacker apparatus, as assembled. FIG. 3 schematically shows pins being guided by the magazine of the conventional tacker apparatus. FIGS. 4A and 4B illustrate the principle of loading the magazine with the pins in the conventional tacker apparatus. FIG. 5 is a side view of a pin guide included in the magazine of the conventional tacker apparatus.

Referring to the drawings, a conventional tacker apparatus 2 includes a tacker body 4 with a piston and a cylinder mounted therein, a guide 6 disposed on the front side of the tacker body 4 to seat a staple or a pin and guide its trajectory, and a magazine 10 disposed at a lower part of the guide 6 and containing a plurality of staples or pins.

A handle (not shown) is formed on the lower part of the magazine 10. A trigger assembly 8 is formed at a predetermined position at the joint between the tacker body 4 and the handle.

Here, the magazine 10 includes a magazine body 12 to contain the staples or pins therein, and a magazine cover 18 mounted to a front side of the magazine body 12 such that it can slide in a vertical direction to allow loading of the staples or pins.

A sliding surface 14 is formed at a front side of the magazine body 12 for a tacker pin 56 to move along. At one side of the sliding surface 14, a prominent surface 16 having a high frictional resistance is attached to cope with friction generated from sliding of the magazine cover 18.

The magazine cover 18 is connected to the magazine body 12 such that it can slide in a vertical direction. The magazine cover 18 includes a cover body 20 having a plurality of grooves on the front side thereof, including: a first pusher linkage guiding groove 22 formed horizontally on one side, a first pin guide inserting groove 26, a second and third pin guide inserting groove 28, a second pusher linkage guiding groove 24, and a prominent surface inserting groove 30. Those grooves are formed in the above order all in a longitudinal direction of the magazine cover 18. Additionally, a pusher contacting surface 32 is formed on the front side of the magazine cover 18, facing the sliding surface 14.

First and second pusher linkages 36 and 38 are inserted and guided in the first pusher linkage guiding groove 22 and the second pusher linkage guiding groove 24, and equipped with connection holes 36*a* and 38*a* on the front sides thereof, respectively. A connection piece 54 of a pusher 52 is inserted into the connection holes 36*a* and 38*a*. A spring 40 is connected to a lower end of the first and second pusher linkages 36 and 38.

The pusher 52 is formed by a square metal piece and includes a connection piece 54 on a rear surface thereof. The connection piece 54 is bent perpendicular to the pusher 52 and engaged with the connection holes 36*a* and 38*a* of the first and second pusher linkages 36 and 38. Therefore, the pusher 52 is actuated by the force of the spring 40, and pushes the tacker pin 56 disposed at an upper end thereof up toward the guide 6.

First to third pin guides 42, 44 and 46 are inserted correspondingly in the first pin guide inserting groove 26 and the second and third pin guide inserting groove 28. In order to securely fix the first to third pin guides 42, 44 and 46, which are made of a thin metal plate, into the first pin guide inserting groove 26 and the second and third pin guide inserting groove 28, a plurality of spacers 48 are attached to the flanks of the first to third pin guides 42, 44 and 46.

The tacker pin 56 of the pusher 52 moves through a gap A formed in a connection area between the magazine 10 and the magazine cover 18. Therefore, the first to third pin guides 42, 44 and 46 are configured so that the pusher 52 is capable of efficiently pushing up the tacker pin 56, by optimally maintaining the gap A.

In addition, pin connection holes are formed at upper and lower ends of the first to third pin guides 42, 44 and 46. An upper pin 34 and a lower pin 50 are connected respectively through the upper and lower pin connection holes, thereby fixing the first to third pin guides 42, 44 and 46 to the magazine cover 18.

In the magazine 10 of the conventional tacker apparatus 2, if the first to third pin guides 42, 44 and 46 connected to the magazine cover 18 protrude too much toward the magazine 10, the tacker pin 56 and the pusher 52 become jammed and unable to move through the gap A between the magazine 10 and the magazine cover 18. Therefore, the first to third pin guides 42, 44 and 46 are configured not to protrude by more than a certain length from the magazine cover 18.

However, when the gap A between the magazine 10 and the magazine cover 18 is formed to exceed a proper size for the above reason, a jam between a tacker pin group 56*a* and another tacker pin group 56*b* may be induced.

More specifically, the tacker pins 56 used in the tacker apparatus 2 are supplied in the form of a tacker pin group formed by engraving uneven lines on a metal piece. Generally, in the same manner as staples, the tacker pins 56 are cut by group and loaded into the magazine 10. However, although the tacker pin group 56*a* disposed at an upper part is supported by the tacker pin group 56*b* disposed at a lower part as shown in FIGS. 4A and 4B, the upper and lower tacker pin groups 56*a* and 56*b* are apt to jam against each other because the gap A of the conventional tacker apparatus 2 is excessively large compared to the thickness of the tacker pin 56 and the pusher 52.

Especially in the case where the tacker pin groups 56*a* and 56*b* are moved to the upper end of the magazine 10 by the pusher 52, when a striking blade 60 moving horizontally to the guide 6 strikes the rear end of the upper tacker pin group 56*a*, the striking force is focused on the rear end. Therefore, the front side of the upper tacker pin group 56*a* is bent downward by a predetermined angle, thereby often generating a jam with the lower tacker pin group 56*b*.

The first to third pin guides 42, 44 and 46 mounted to the magazine 10 of the conventional tacker apparatus 2 are in tight contact with the magazine body 12, keeping a small gap with the magazine body 12 so as to be pushed smoothly upward by the pusher 52. However, when the upper front ends of the first to third pin guides 42, 44 and 46 are vertically formed, the last tacker pin 56 cannot correctly reach a striking position.

Accordingly, in order to shoot the last individual tacker pin 56, a corner-R processing (b) should be performed on the upper front ends of the first to third pin guides 42, 44 and 46.

SUMMARY OF THE INVENTION

Therefore, the present invention has been made in view of the above problems, and it is an object of the present invention to provide a jam-resistant tacker apparatus, capable of preventing the tacker pins from jamming against each other by forming a slit for engagement with an upper pin at the upper ends of a plurality of pin guides mounted to a magazine cover and forming a seating recess for receiving the upper pin at a predetermined position of a magazine so that the forward and backward movement range of the pin guides is increased, and by providing a spring having less elasticity than a spring of a pusher at the upper rear ends of the plurality of pin guides, so that a tacker pin and the pusher can be guided while in constant contact with the magazine.

In accordance with the present invention, the above and other objects can be accomplished by the provision of a tacker apparatus comprising a tacker body 4 with a piston and a cylinder mounted therein, a guide 6 disposed on the front side of the tacker body 4 to seat a staple or a pin and to guide its trajectory, a magazine 10 containing a plurality of the staples or pins therein, a magazine cover 18 connected to the magazine 10, first and second pusher linkages 36 and 38 respectively inserted in recesses formed at both front sides of the magazine cover 18 in a longitudinal direction, engaged with a rear surface of a pusher 52, and connected with a spring 40 at a lower part to push upward a tacker pin 56 loaded between the magazine 10 and the magazine cover 18, wherein the pusher 52 is engaged with the first and second pusher linkages 36 and 38 at the rear surface to push the tacker pin 56 upward, the tacker apparatus further comprising: first to third pin guides 42, 44 and 46 inserted into recesses formed in a longitudinal direction at predetermined front sides of the magazine cover 18 to bring the tacker pin 56 into tight contact with the magazine 10; a plurality of spacers 48 connected to the flanks of the first to third pin guides 42, 44 and 46 to guide the insertion of the first to third pin guides 42, 44 and 46 into the recesses of the magazine cover 18; and springs 66 each connected to a rear surface of the spacers 48 to push the upper parts of the first to third pin guides 42, 44 and 46 in a direction away from the magazine cover 18 toward the magazine 10, such that the tacker pin 56 and the pusher 52 moving through an inner gap formed between the magazine 10 and the magazine cover 18 can be guided while in tight contact with the magazine 10 and a jam between tacker pin groups disposed at an upper part and a lower part can be prevented.

Preferably, the first to third pin guides 42, 44 and 46 may each include a horizontally oriented slit 64 at upper parts thereof for engagement with an upper pin 34 so that the movement range of the upper parts of the first to third pin guides 42, 44 and 46 toward the magazine 10 is increased.

The tacker apparatus may further comprise a seating recess 62 formed on a prominent surface 16 of the magazine 10 to receive the upper pin 34 so that the movement range of the first to third pin guides 42, 44 and 46 toward the magazine 10 can be increased.

The springs 66 may be fixed to the rear surfaces of certain spacers disposed at an upper part among the plurality of spacers such that the first to third pin guides 42, 44 and 46 are brought into tighter contact with the magazine 10 as the tacker pin 56 moves upward.

The upper front ends of the first to third pin guides 42, 44 and 46 may have a vertical-processing part (c).

DETAILED DESCRIPTION OF THE PREFERRED EMBODIMENTS

Hereinafter, an embodiment of the present invention will be described in detail with reference to the accompanying drawings.

Figure 1A:
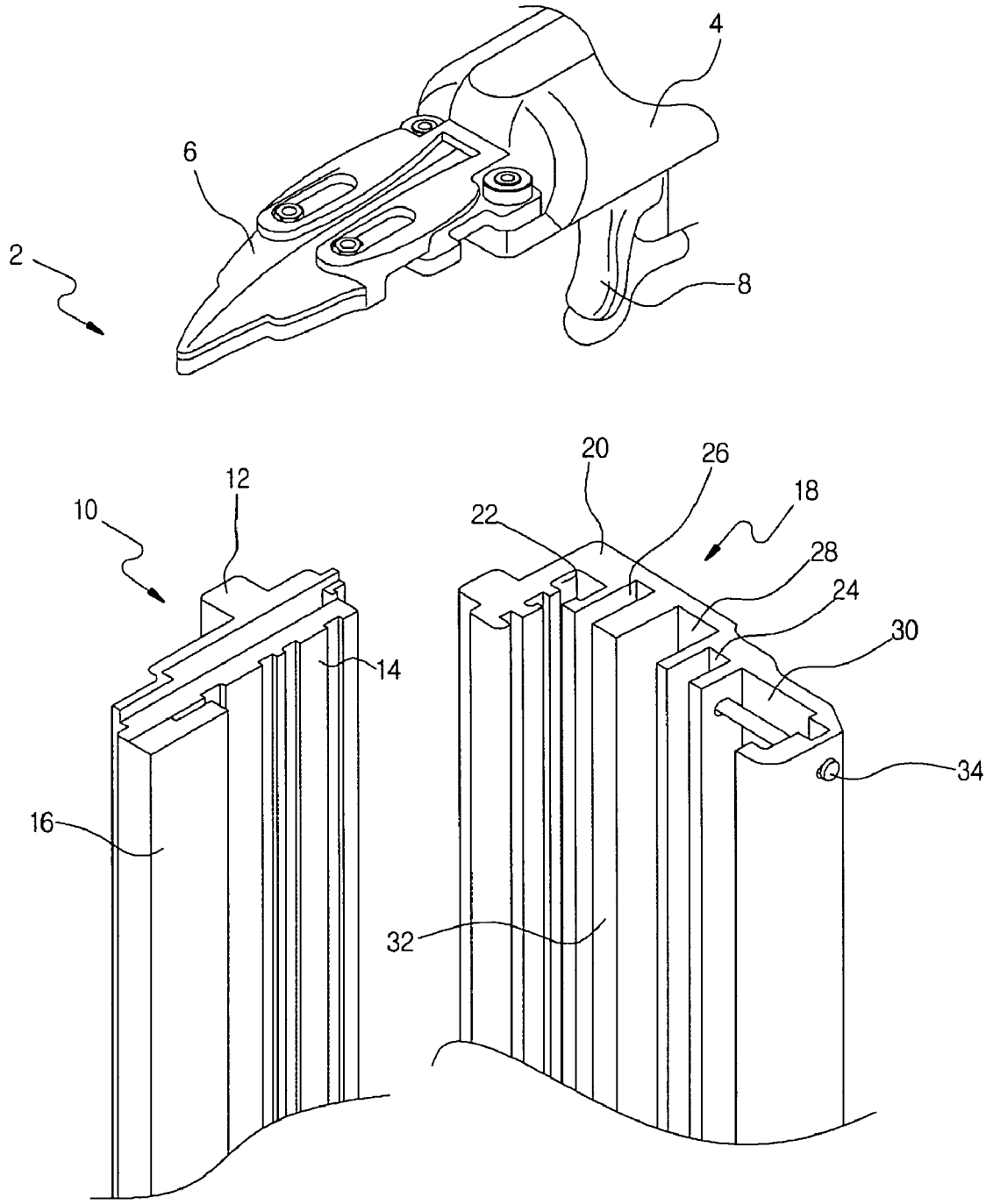
FIGS. 1A and 1B are exploded perspective views illustrating the respective structures of a magazine and of pin guide members constituting a conventional tacker apparatus.
Figure 1B:
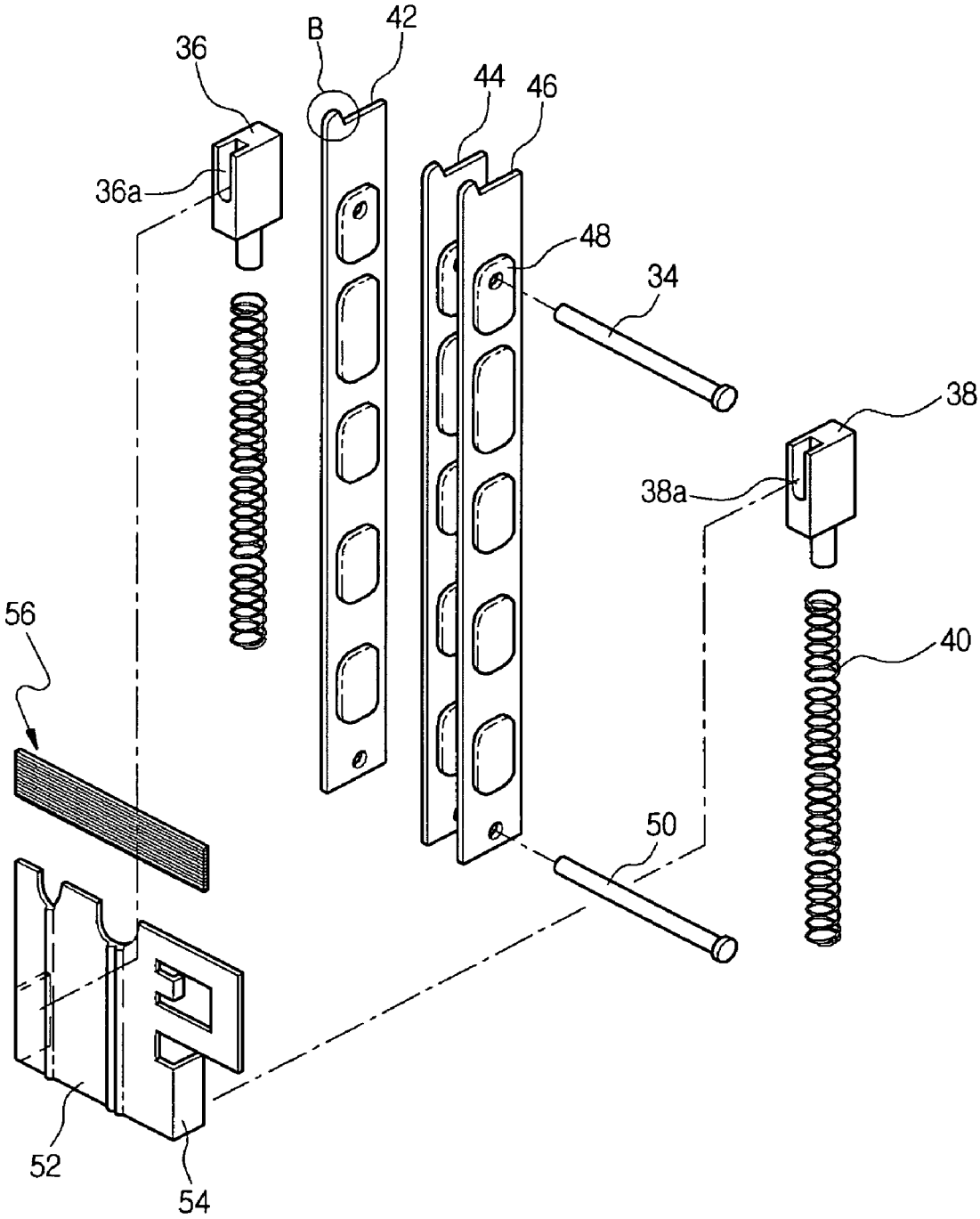
Figure 2:
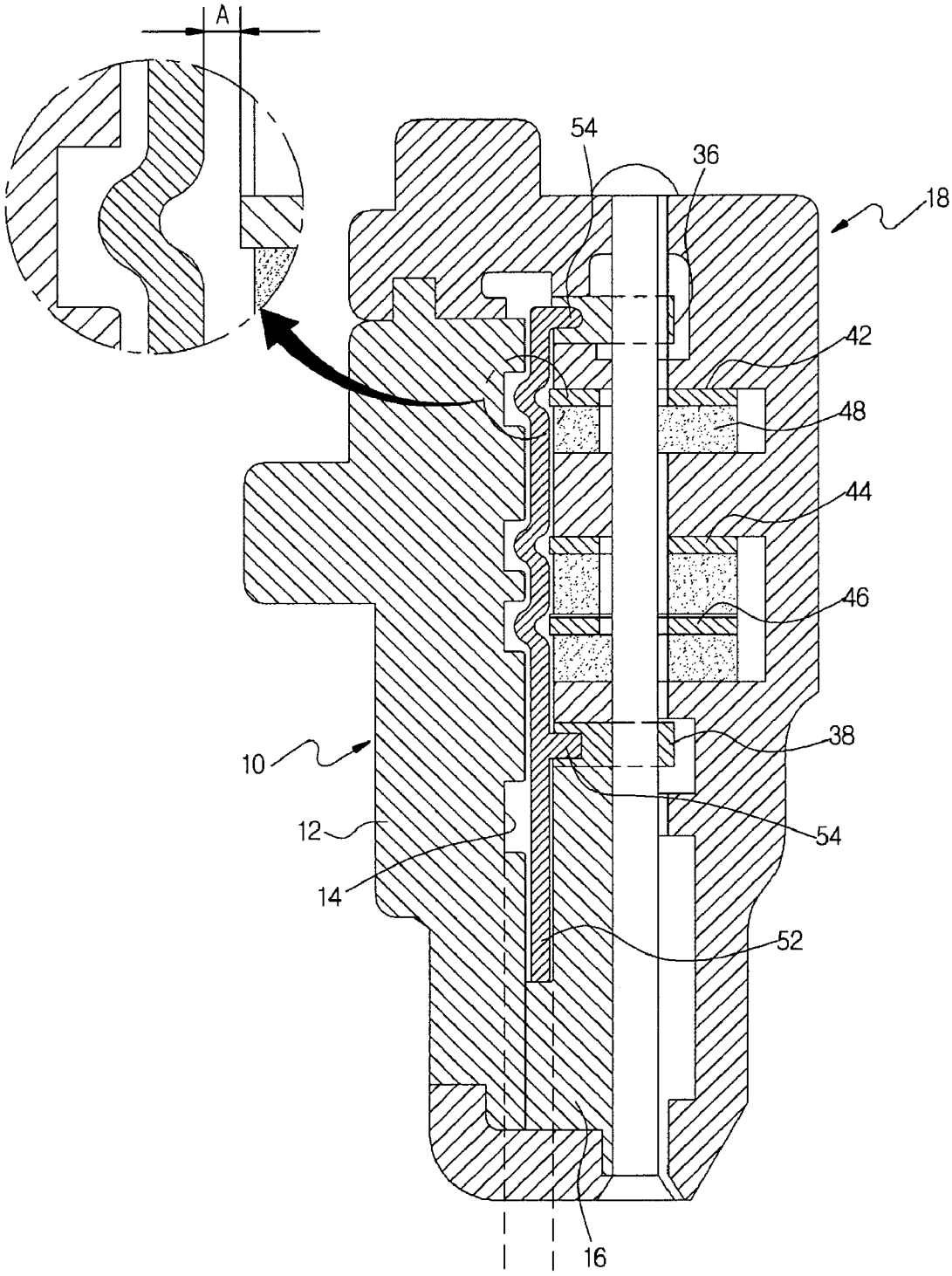
FIG. 2 is a plan sectional view showing the magazine of the conventional tacker apparatus, as assembled.
Figure 3:
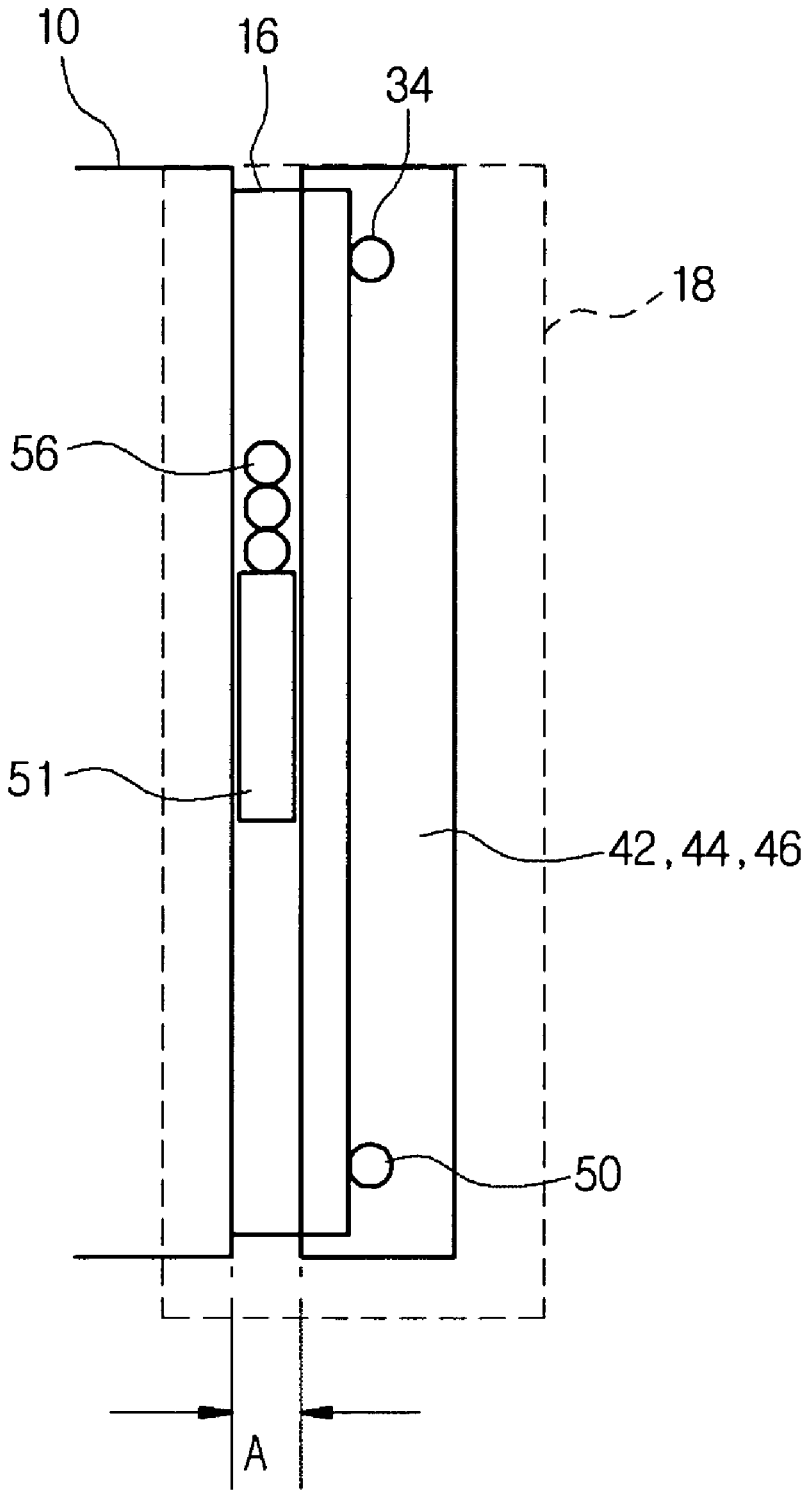
FIG. 3 schematically shows pins being guided by the magazine of the conventional tacker apparatus.
Figure 4A:
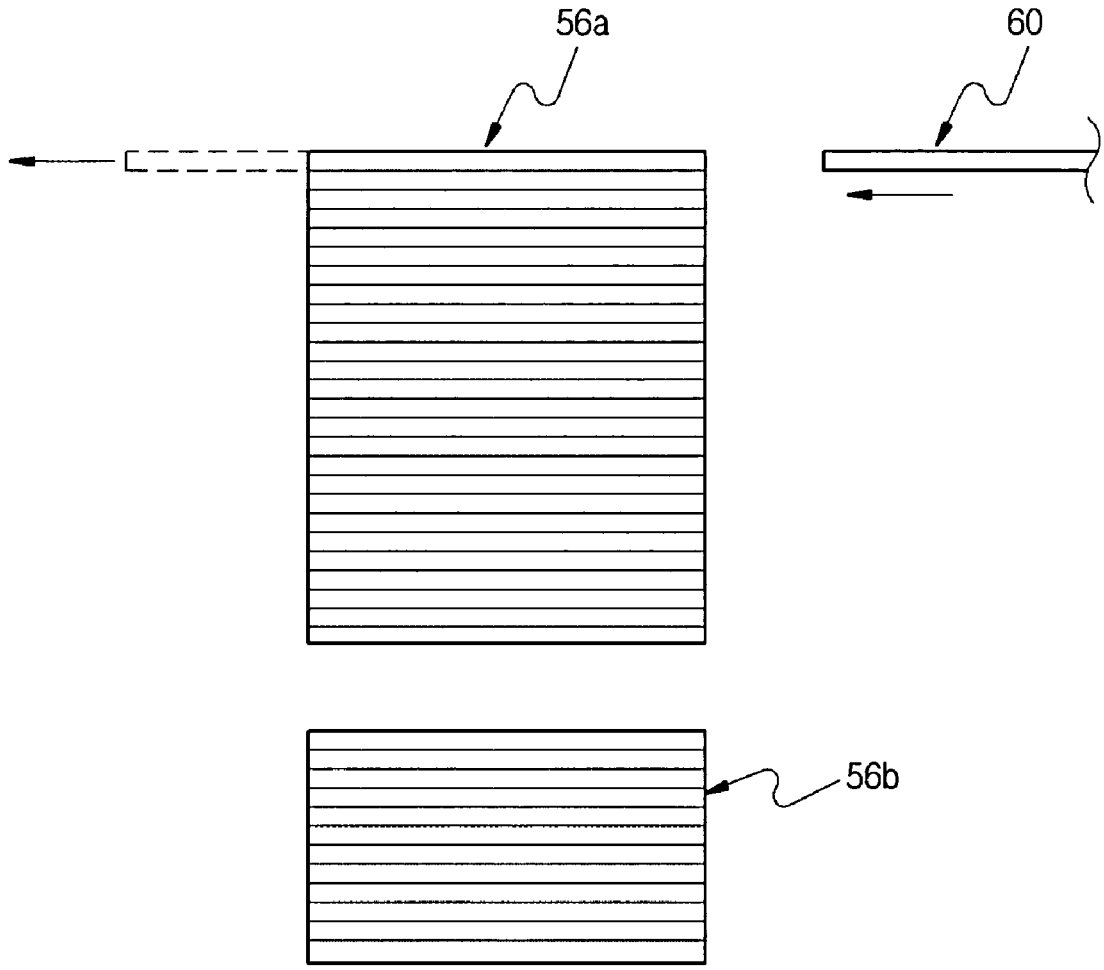
FIGS. 4A and 4B illustrate the principle of loading the magazine with the pins in the conventional tacker apparatus.
Figure 4B:
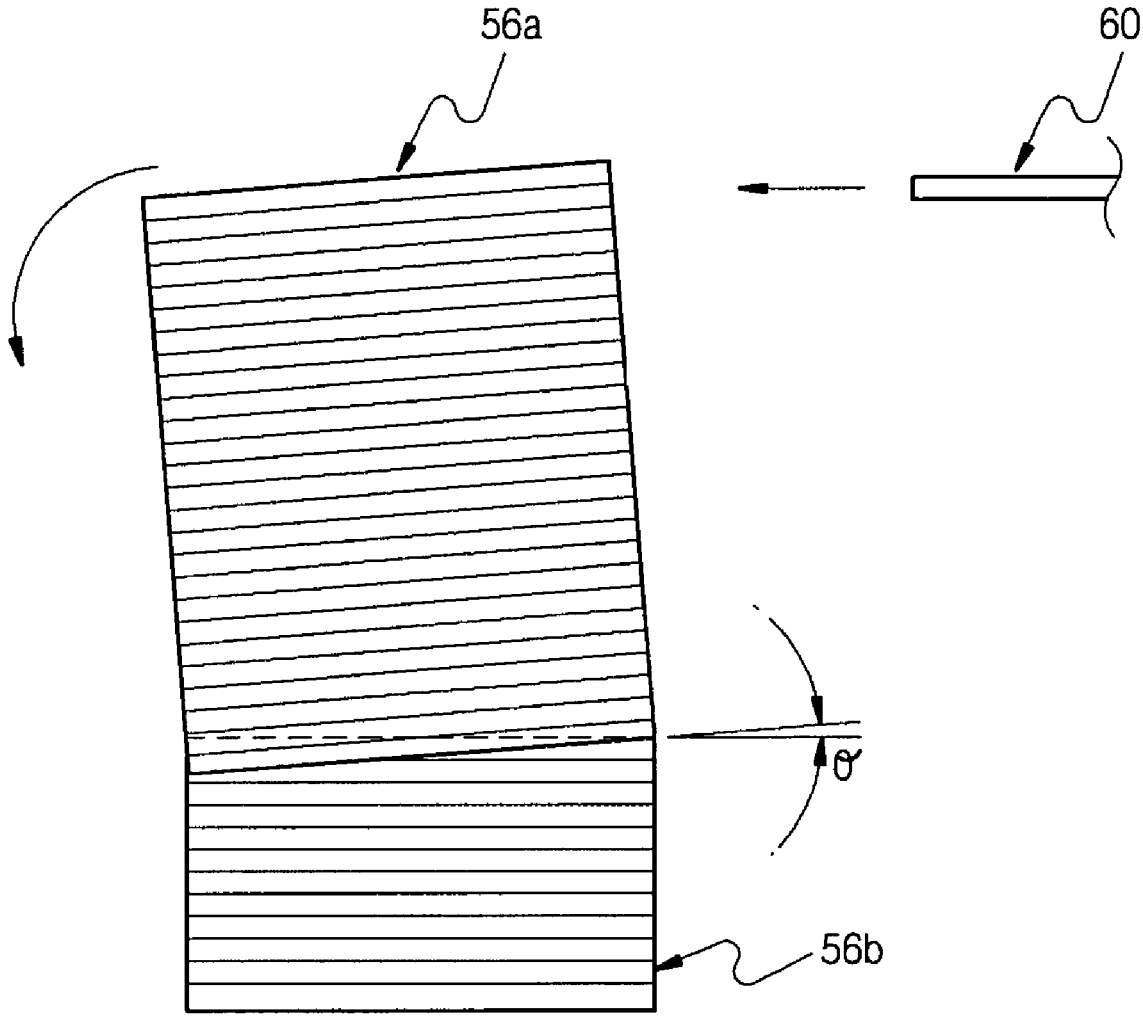
Figure 5:
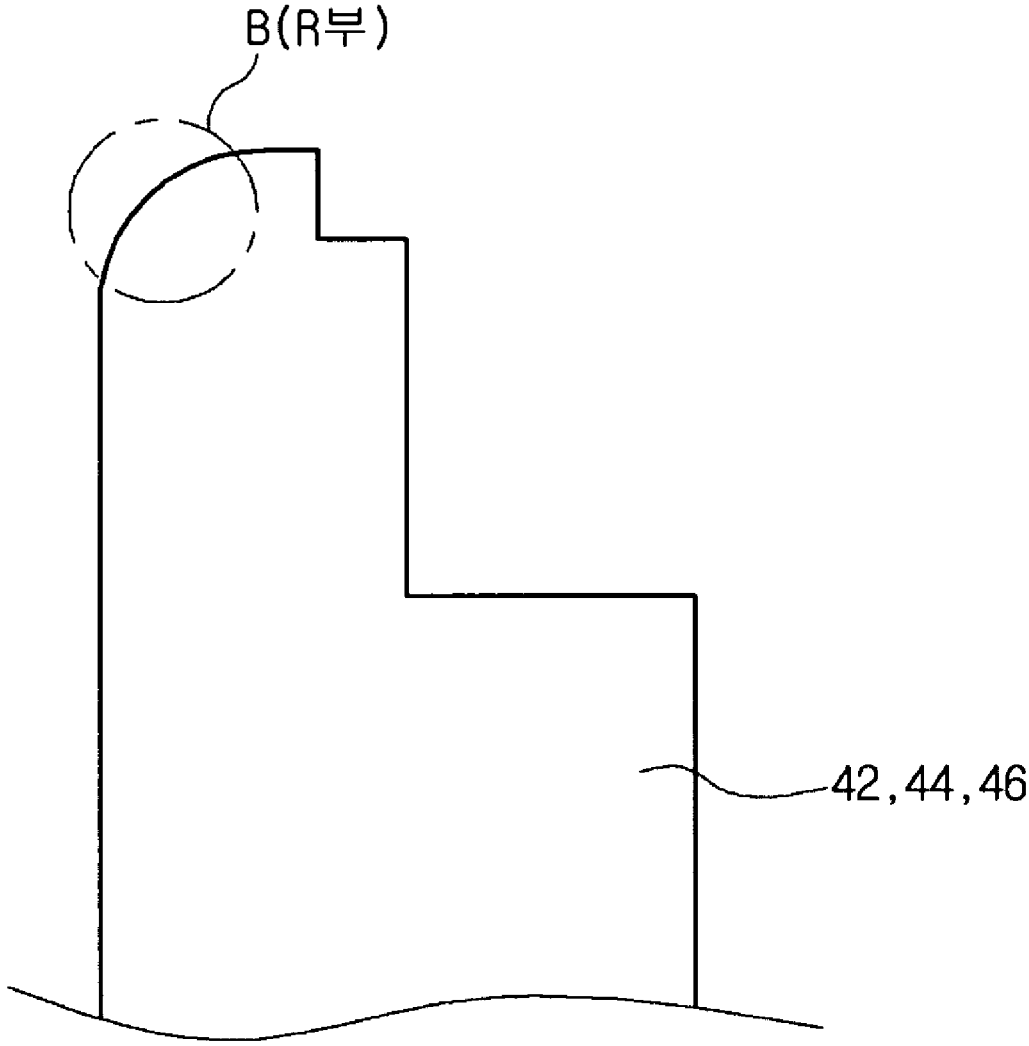
FIG. 5 is a side view of a pin guide included in the magazine of the conventional tacker apparatus.
Figure 6:
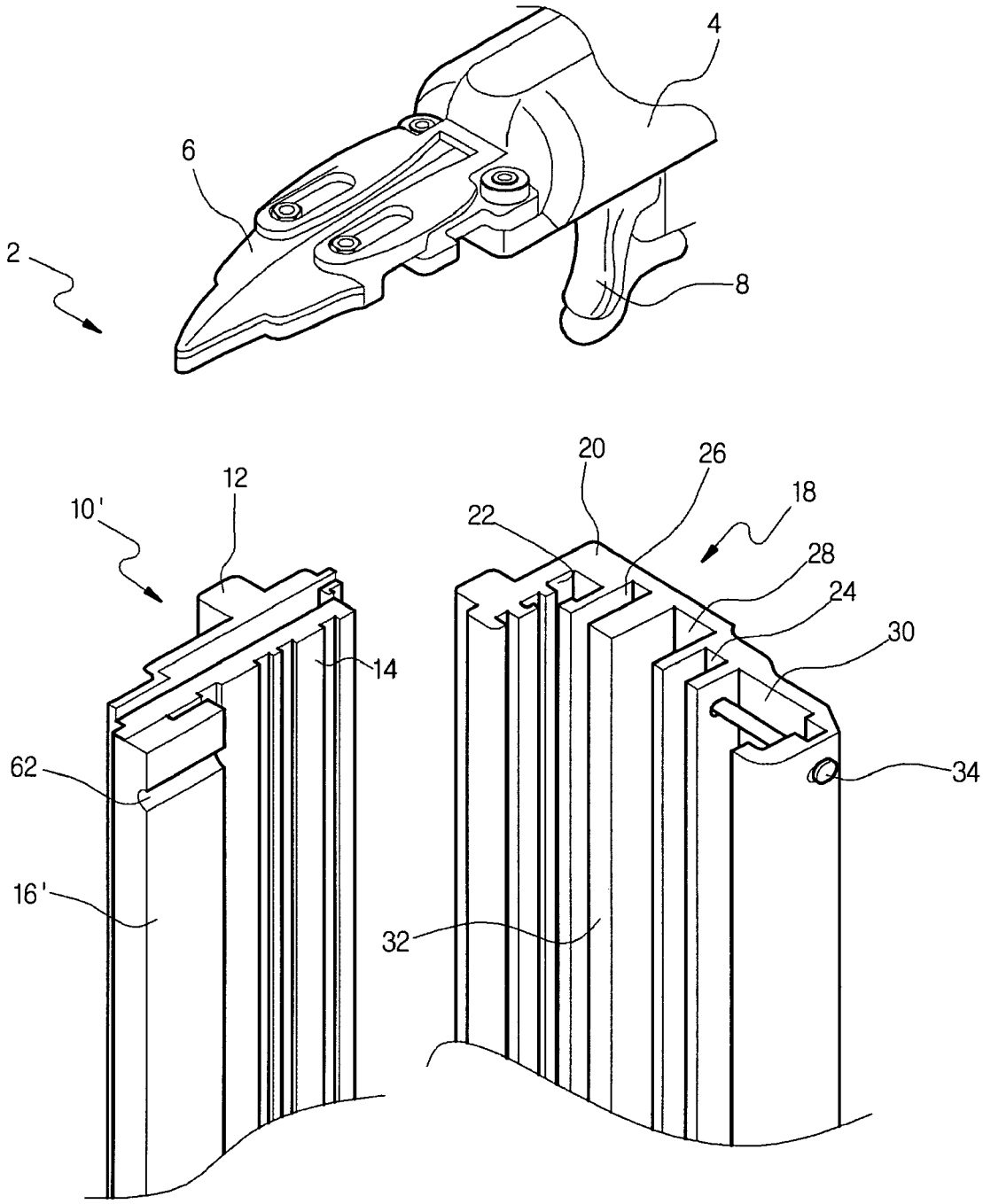
FIG. 6 is an exploded perspective view showing the structure of a magazine employed by the jam-resistant tacker apparatus according to an embodiment of the present invention.
Figure 7:
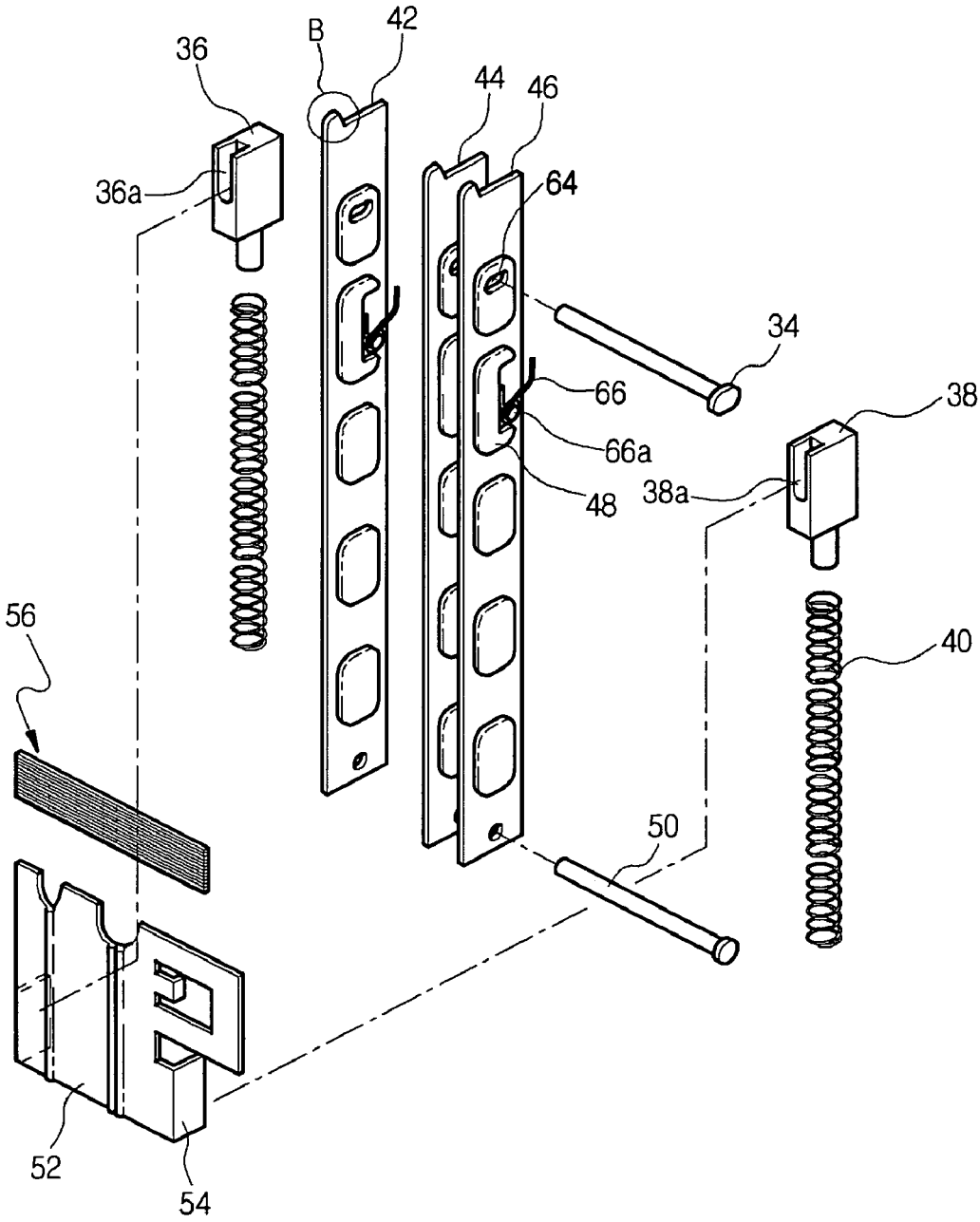
FIG. 7 is an exploded perspective view showing the structure of pin guide members installed in the magazine of the tacker apparatus according to the embodiment of the present invention.
Figure 8:
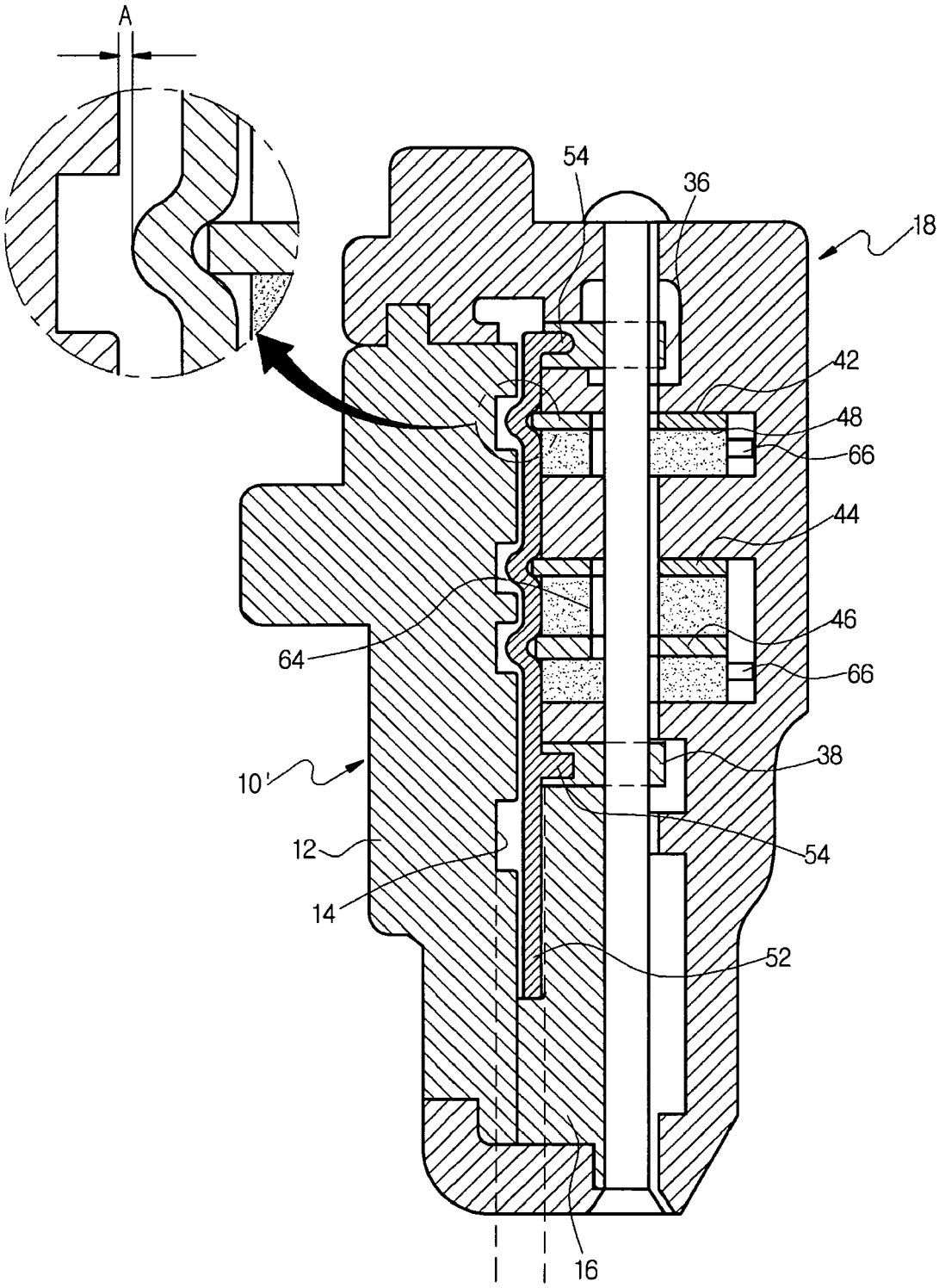
FIG. 8 is a plan sectional view showing the magazine of the tacker apparatus according to the embodiment of the present invention, as assembled.
Figure 9:
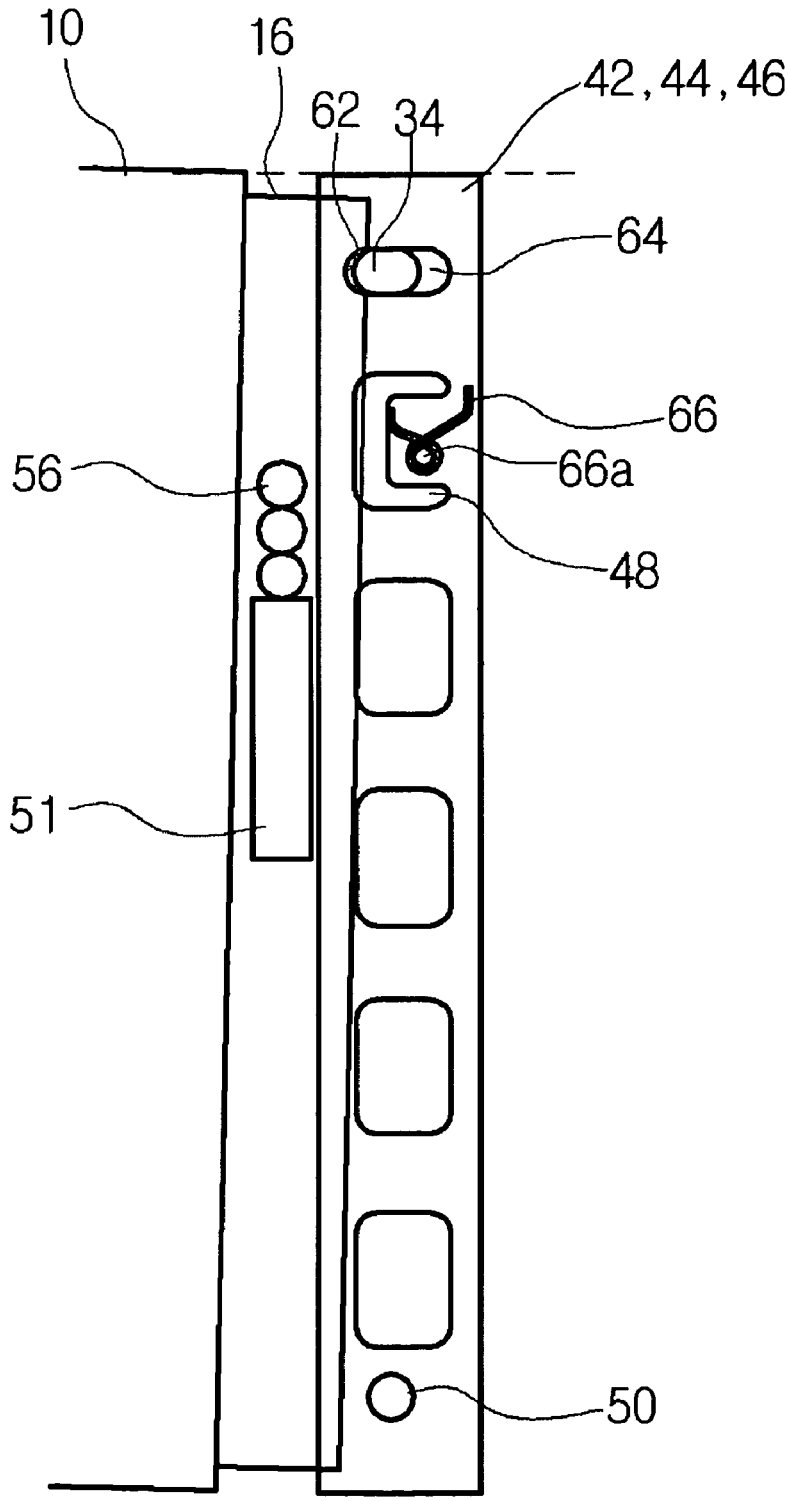
FIG. 9 schematically shows pins being guided by the magazine of the tacker apparatus according to the embodiment of the present invention.

FIG. 6 is an exploded perspective view showing the structure of a magazine employed in a jam-resistant tacker apparatus according to an embodiment of the present invention. FIG. 7 is an exploded perspective view showing the structure of pin guide members installed in the magazine of the tacker apparatus according to the embodiment of the present invention. FIG. 8 is a plan sectional view showing the magazine of the tacker apparatus according to the embodiment of the present invention, as assembled, and FIG. 9 schematically shows pins being guided by the magazine of the tacker apparatus according to the embodiment of the present invention.

Referring to the drawings, a jam-resistant tacker apparatus 2' has a slit formed at the upper end of each of a plurality of pin guides mounted to a magazine cover to engage with an upper pin, and a seating recess formed at a predetermined position on the magazine to engage with the upper pin, such that the forward and backward movement range of the pin guides is increased. Also, the tacker apparatus 2' has a spring having less elasticity than a spring of a pusher, at upper rear ends of the plurality of pin guides so that a tacker pin and the pusher can be guided while in constant contact with the magazine. As a result, the tacker apparatus 2' is capable of preventing jamming of the tacker pins.

In the same manner as the conventional tacker apparatus 2, the tacker apparatus 2' according to an embodiment of the present invention comprises a tacker body 4 including therein a piston and a cylinder, a guide 6 disposed on the front side of the tacker body 4 to seat a staple or a pin and guide its trajectory, and a magazine 10' disposed at a lower part of the guide 6 and containing a plurality of the staples or pins therein.

A handle (not shown) is formed on a lower part of the magazine 10'. A trigger assembly 8 is formed at a predetermined position at the joint between the tacker body 4 and the handle.

Here, the magazine 10' includes a magazine body 12 for holding the staples or pins therein, and a magazine cover 18 mounted to the front side of the magazine body 12 such that it can slide in a vertical direction to allow loading of the staples or pins.

A sliding surface 14 is formed on the front side of the magazine body 12 for a tacker pin 56 to move along. At one side of the sliding surface 14, a prominent surface 16 having a high frictional resistance is attached to cope with friction generated from sliding of the magazine cover 18.

The magazine cover 18 is connected to the magazine body 12 such that it can slide in a vertical direction. The magazine cover 18 includes a cover body 20 having a plurality of grooves on a front side thereof, including: a first pusher linkage guiding groove 22 formed horizontally on one front side of the cover body 20, a first pin guide inserting groove 26, a second and third pin guide inserting groove 28, a second pusher linkage guiding groove 24, and a prominent surface inserting groove 30. Those grooves are formed in the above order all in the longitudinal direction of the magazine cover 18. Additionally, a pusher contacting surface 32 is formed on the front side of the magazine cover 18, facing the sliding surface 14.

First and second pusher linkages 36 and 38 are inserted and guided in the first pusher linkage guiding groove 22 and the second pusher linkage guiding groove 24, and are equipped with connection holes 36*a* and 38*a* on the front sides thereof, respectively. A connection piece 54 of a pusher 52 is inserted into the connection holes 36*a* and 38*a*. A spring 40 is connected to a lower end of the first and second pusher linkages 36 and 38.

The pusher 52 is formed by a square metal piece and includes the connection piece 54 on a rear surface thereof. The connection piece 54 is bent perpendicular to the pusher 52 and engaged with the connection holes 36*a* and 38*a* of the first and second pusher linkages 36 and 38. Therefore, the pusher 52 is actuated by the force of the spring 40, and pushes the tacker pin 56 disposed at an upper end thereof up toward the guide 6.

First to third pin guides 42, 44 and 46 are inserted correspondingly in the first pin guide inserting groove 26 and the second and third pin guide inserting groove 28. In order to securely fix the first to third pin guides 42, 44 and 46, which are made of a thin metal plate, into the first pin guide inserting groove 26 and the second and third pin guide inserting groove 28, a plurality of spacers 48 are attached to the flanks of the first to third pin guides 42, 44 and 46.

The tacker pin 56 of the pusher 52 moves through a gap A formed in a connection area between the magazine 10' and the magazine cover 18. Therefore, the first to third pin guides 42, 44 and 46 are configured so that the pusher 52 is capable of efficiently pushing up the tacker pin 56, by optimally maintaining the gap A.

In addition, pin connection holes are formed at upper and lower ends of the first to third pin guides 42, 44 and 46. An upper pin 34 and a lower pin 50 are connected respectively through the upper and lower pin connection holes, thereby fixing the first to third pin guides 42, 44 and 46 to the magazine cover 18.

Here, a spring 66 is connected to a rear surface of one of the spacers 48 disposed at an upper part, to push the first to third pin guides 42, 44 and 46 away from the magazine cover 18 and toward the magazine 10. Accordingly, the tacker pin 56 and the pusher 52 moving through the gap between the magazine 10 and the magazine cover 18 can be guided while maintaining tight contact with the magazine 10.

More particularly, in the tacker apparatus 2' according to the embodiment of the present invention, the spring 66, since it is fixed by a fixing projection 66*a* at the rear surface of the upper spacer 48, can stably guide the tacker pin 56 by pushing the upper parts of the first to third pin guides 42, 44 and 46 toward the magazine 10. Therefore, when striking the upper tacker pin group 56*a*, the upper tacker pin group 56*a* does not fall down and generate a jam with the lower tacker pin group 56*b*.

Because the elasticity of the spring 66 pushing the upper parts of the first to third pin guides 42, 44 and 46 is less than the elasticity of the spring 40 pushing the pusher 52 upward, the movement of the pusher 52 caused by the spring 66 is not interfered with.

Meanwhile, the first to third pin guides 42, 44 and 46 each have a slit 64, oriented horizontally at the upper parts thereof for engagement with the upper pin 34 so as to increase the movement range of the upper parts of the first to third pin guides 42, 44 and 46 toward the magazine 10.

On the prominent surface 16 of the magazine 10 contacting the upper pin 34 connected with the magazine cover 18, a seating recess 62 for receiving the upper pin 34 is additionally formed so that the movement range of the first to third pin guides 42, 44 and 46 toward the magazine 10 is increased.

The upper pin 34 tightly contacts the prominent surface 16 of the magazine 10 while remaining fixed to the magazine cover 18. The first to third pin guides 42, 44 and 46 have the slit 64 extending horizontally at the upper parts thereof. Therefore, the first to third pin guides 42, 44 and 46 are able to move further toward the sliding surface 14 of the magazine 10. Also, since the upper pin 34 is partly received into the seating recess 62 of the prominent surface 16 of the magazine 10, the first to third pin guides 42, 44 and 46 can be moved toward the magazine 10 to a further degree.

Thus, because the first to third pin guides 42, 44 and 46 push the tacker pin 6 toward the magazine 10, the tacker pin 56 can be stably guided upward without causing a jam.

The spring 66 pushing forward the first to third pin guides 42, 44 and 46 is fixed to a certain spacer disposed at the upper parts of the pin guides 42, 44 and 46 among the spacers 48 attached to the flanks of the first to third pin guides 42, 44 and 46 at predetermined intervals. Accordingly, as the tacker pin 56 is moved upward, the first to third pin guides 42, 44 and 46 are brought into tighter contact with the magazine 10.

Because the striking force of the striking blade 60 that strikes the tacker pin 56 that is in the firing position at the upper part of the tacker apparatus 2' can cause a jam between one tacker pin group and another tacker pin group, the tacker pin 56 needs to contact the sliding surface 14 of the magazine 10 more tightly as the tacker pin 56 is gradually pushed upward. Therefore, since the spring 66 pushing the first to third pin guides 42, 44 and 46 forward is fixed to the upper spacer 48, only the upper parts of the first to third pin guides 42, 44 and 46 are pushed on by the elastic force of the spring 66.

As shown in FIG. 9, the first to third pin guides 42, 44 and 46 are inclined by a predetermined angle on the inside of the magazine 10 and the magazine cover 18. Accordingly, the gap between the magazine 10 and the first to third pin guides 42, 44 and 46 narrows going upward.

Figure 10:
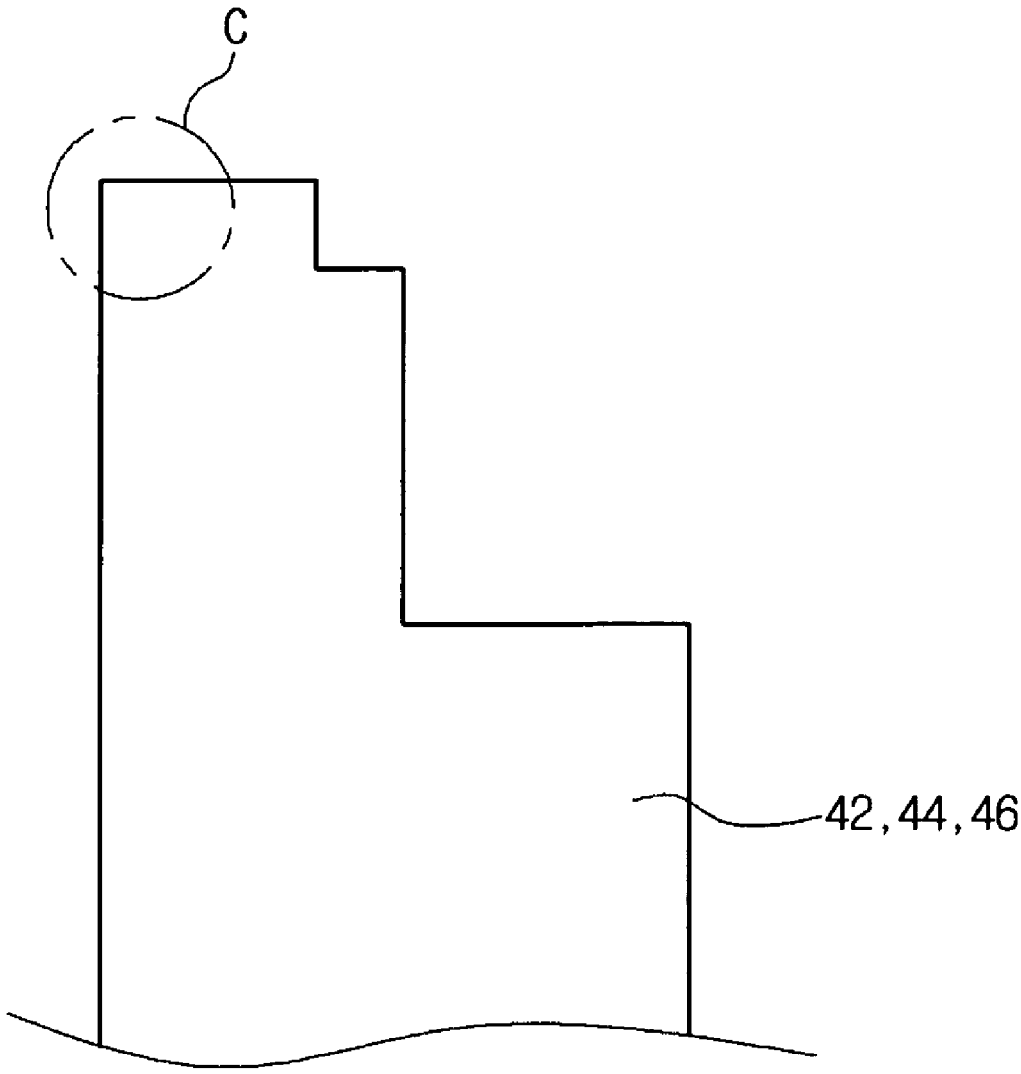
FIG. 10 is a side view of a pin guide included in the magazine of the tacker apparatus according to the embodiment of the present invention.

FIG. 10 is a side view of the pin guide included in the magazine 10 of the tacker apparatus 2' according to the embodiment of the present invention.

Referring to FIG. 10, in the tacker apparatus 2', the spring 66 is connected to the rear surface of the upper spacer 48 to stably guide the tacker pin 56 by pushing the upper parts of the first to third pin guides 42, 44 and 46 toward the magazine 10. As a consequence, when the upper tacker pin group 56*a* is struck, a jam between the upper tacker pin group 56*a* and the lower tacker pin group 56*b* is not generated.

As shown in FIG. 10, therefore, even at the time of shooting the last tacker pin 56, the upper front ends of the first to third pin guides 42, 44 and 46 do not require a dedicated corner-R processing (b) that would otherwise be conventionally demanded. In other words, although the upper front ends of the first to third pin guides 42, 44 and 46 are vertically processed (c), the last tacker pin 56 can be successfully fired.

As described above, the tacker apparatus according to the present invention is able to prevent the problem of jammed tacker pins, by applying a horizontal elasticity for stably guiding the tacker pin horizontally in addition to an upward elasticity for moving the tacker pin upward. As a result, economic efficiency and convenience of the tacker apparatus can be remarkably enhanced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tacker apparatus having a tacker body with a piston and a cylinder mounted therein, a guide disposed on the front side of the tacker body to seat a staple or a pin and guide the trajectory of the staple or the pin, the tacker comprising:

a magazine (10) containing a plurality of staples or pins therein, a magazine cover (18) connected to the magazine 10, first and second pusher linkages (36, 38) respectively inserted into longitudinal recesses formed at both front sides of the magazine cover (18), engaged with a rear surface of a pusher (52), and connected with a spring (40) at a lower part to push upward a tacker pin (56) loaded between the magazine (10) and the magazine cover (18), wherein the pusher (52) is engaged with the first and second pusher linkages (36, 38) at their rear surfaces to push the tacker pin (56) upward, a first to third pin guides (42, 44, 46) inserted into recesses formed in a longitudinal direction at predetermined front sides of the magazine cover (18) to bring the tacker pin (56) into tight contact with the magazine (10), a plurality of spacers (48) connected to the flanks of the first to third pin guides (42, 44, 46) to guide the insertion of the first to third pin guides (42, 44, 46) into the recesses of the magazine cover (18), and springs (66) each connected to the rear surfaces of the spacers (48) to push the upper parts of the first to third pin guides (42, 44, 46) away from the magazine cover (18) and toward the magazine (10), such that the tacker pin (56) and the pusher (52) move through an inner gap formed between the magazine (10) and the magazine cover (18) while maintaining tight contact with the magazine (10) and a jam between tacker pin groups disposed at an upper part and a lower part can be prevented.

2. The jam-resistant tacker apparatus according to claim 1, wherein the first to third pin guides (42, 44, 46) each include a horizontally oriented slit (64) on the upper parts thereof for engagement with an upper pin (34) so that the movement range of the upper parts of the first to third pin guides (42, 44, 46) toward the magazine (10) is increased.

3. The jam-resistant tacker apparatus according to claim 2, further comprising a seating recess (62) formed on a prominent surface (16) of the magazine (10) in contact with the upper pin (34) connected in the magazine cover (18) to receive the upper pin (34) so that the movement range of the first to third pin guides (42, 44, 46) toward the magazine (10) can be increased.

4. The tacker apparatus according to claim 1, wherein the springs (66) are fixed to the rear surfaces of certain spacers disposed at an upper part among the plurality of spacers such that the first to third pin guides (42, 44, 46) are brought into tighter contact with the magazine (10) as the tacker pin (56) moves upward.

5. The tacker apparatus according to claim 1, wherein the upper front ends of the first to third pin guides (42, 44, 46) have a vertical-processing part (c).

* * * * *